US005711229A

United States Patent [19]

Piretti

[11] Patent Number: 5,711,229

[45] Date of Patent: Jan. 27, 1998

[54] EXTENSIBLE TABLE

[75] Inventor: Giancarlo Piretti, Bologna, Italy

[73] Assignee: Pro-Cord S.R.L., Bologna, Italy

[21] Appl. No.: 621,875

[22] Filed: Mar. 26, 1996

[30] Foreign Application Priority Data

Apr. 6, 1995 [IT] Italy ..... TO95A0265

[51] Int. Cl.[6] ..... A47B 1/06

[52] U.S. Cl. ..... 108/67; 108/89

[58] Field of Search ..... 108/89, 87, 88, 108/85, 83, 78, 79, 69, 67, 74

[56] References Cited

U.S. PATENT DOCUMENTS

| | | | |
|---|---|---|---|
| 6,557 | 6/1849 | Sherborne | 108/87 |
| 102,235 | 4/1870 | Dietsch | 108/67 |
| 674,420 | 5/1901 | Kopp | 108/67 |
| 852,011 | 4/1907 | Arnold | 108/88 |
| 1,009,902 | 11/1911 | Hanson | 108/89 |
| 2,162,032 | 6/1939 | Rudman et al. | 108/83 X |
| 2,699,975 | 1/1955 | Ranney | 108/67 |
| 2,852,325 | 9/1958 | Fosnaugh | 108/78 X |

FOREIGN PATENT DOCUMENTS

| | | | |
|---|---|---|---|
| 3113543 | 10/1982 | Germany | 108/88 |
| 1831314 | 7/1993 | Russian Federation | 108/67 |

*Primary Examiner*—José V. Chen

*Attorney, Agent, or Firm*—Sughrue, Mion, Zinn, Macpeak & Seas, PLLC

[57] ABSTRACT

An extensible table comprises a foldable board and a pair of basis structures, at least one of which is mounted on wheels, the two basis structures rigidly support respective end portions of the foldable board and are displaceable between a first operative condition in which they are spaced apart from each other, with the foldable board fully extended, and a second operative condition in which they are adjacent to each other, with the foldable board folded.

7 Claims, 9 Drawing Sheets

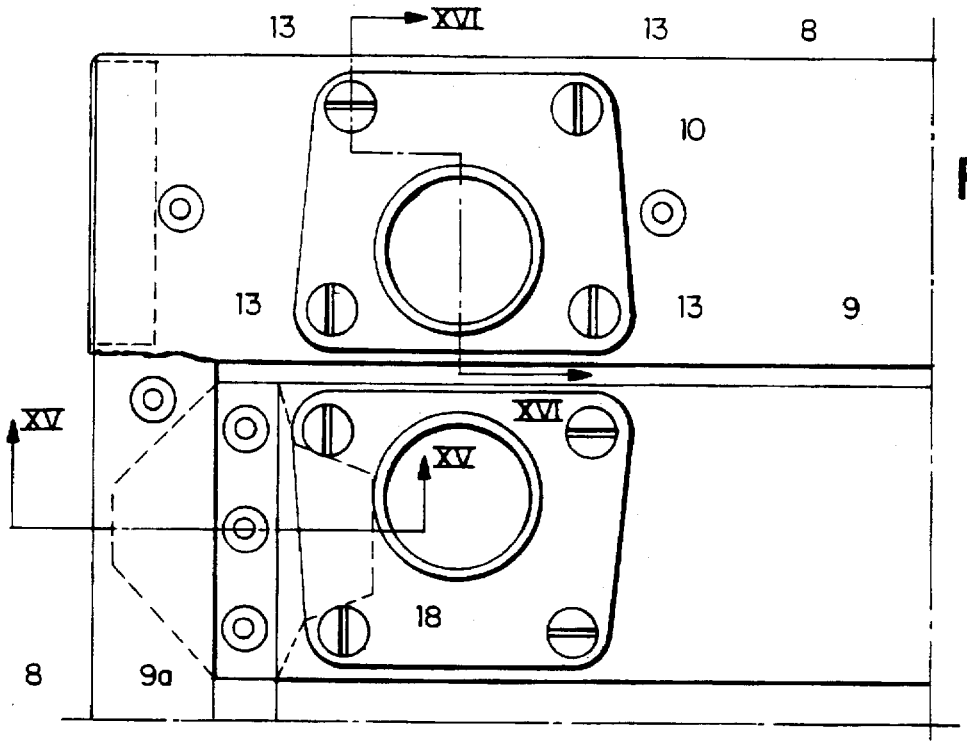
FIG. 14
FIG. 15
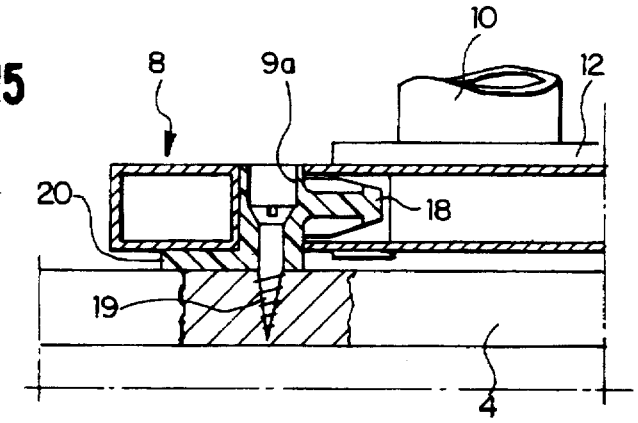
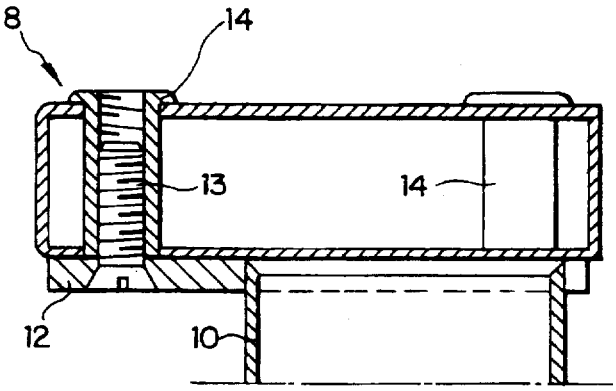
FIG. 16

EXTENSIBLE TABLE

SUMMARY OF THE INVENTION

The present invention relates to extensible tables and has as its object that of providing a table of this type which on one hand has a structure simple and inexpensive to manufacture and which on the other hand can be transformed by the user from a shortened condition to an extended condition, and vice versa, without effort and with easy and rapid operations.

In view of achieving this object, the invention provides and extensible table, characterized in that it comprises a foldable board and a pair of base structures, at least one of which is mounted on wheels, which rigidly support respective end portions of said foldable board and are displaceable between a first operative condition in which they are spaced apart from each other, with the foldable board fully extended, and a second operative condition in which they are adjacent to each other, with the foldable board folded, said base structures being provided with means for their mutual fit in the said second operative condition.

In a preferred embodiment, said foldable board comprises a central portion connected at two opposite sides to said end portions carried by the two base structures, with the interposition of two intermediate board portions, each of which is articulated on one side to the respective end portion of the foldable board and on the opposite side to said central portion, so that in said second operative condition the central portion forms the table board, with the two intermediate portions and the two end portions folded therebelow.

Due to the above indicated features, the table according to the invention can be provided with an extremely simple and unexpensive structure. At the same time, the user may obtain conversion between said two operative conditions without effort and with simple and rapid operations. For example, supposing that the table is in its second operative condition, i.e. in its shortened condition, the user must simply grasp the central portion of the foldable board (which forms the only board of the table in the shortened condition) and raise it upwardly. As a result of the presence of the wheels provided below at least one of the two base structures, said raising movement will cause automatically the two base structures to move away from each other so as to bring the table in the condition with extended board.

The two base structures of the table each comprise an upper frame lying in a horizontal plane, carrying the respective end portion of the table board on it and provided at its lower part with legs, said upper frames of the two base structures being configured so that they do not interfere with each other in said second operative condition.

In one embodiment, one of the frames of the two base structures has a quadrangular structure and the other frame has a U-shaped structure which is for receiving therewithin said quadrangular structure of the other frame in said second operative condition of the table. Yet in said embodiment, only one of the two base structures has legs which are provided at their lower ends with wheels. Yet in said embodiment, the U-shaped frame and the quadrangular frame are formed by tubular sheet metal elements with a flattened rectangular cross section. Said means for mutual fitting comprise horizontal studs fixed to the lower surface of the two end portions of the table board and adapted to be received each within a cooperating aperture provided in the frame carrying the other end portion of the table board when the table is in its second operative condition, said studs being made of plastic material and having a tapered configuration.

Naturally, while the preferred embodiment which has been described above has a board with a central portion which in the shortened condition of the table forms the sole board of the table and which in the extended condition is extended on both its opposite sides, it is possible to provide for said board portion to be extended only on one side when the table is extended.

In the folded condition of the table, below its upper board, as a result of the superimposed folded parts, there is defined a gap which makes easier for the user to grasp the board in order to raise it, when it is necessary to convert the table to the extended configuration.

Therefore, the operations which are necessary for converting the table do not require any effort and are easy and rapid.

BRIEF DESCRIPTION OF THE DRAWINGS

Further features and advantages of the invention will become apparent from the description which follows with reference to the annexed drawings, given purely by way of non limiting example, in which:

FIG. 14 is a view at an enlarged scale of a detail of FIG. 8, FIG. 15 is a cross-sectional view taken along line XV—XV of FIG. 14, and FIG. 16 is a cross-sectional view taken along line XVI—XVI of FIG. 14.

DESCRIPTION OF THE PREFERRED EMBODIMENT

Figure 1:
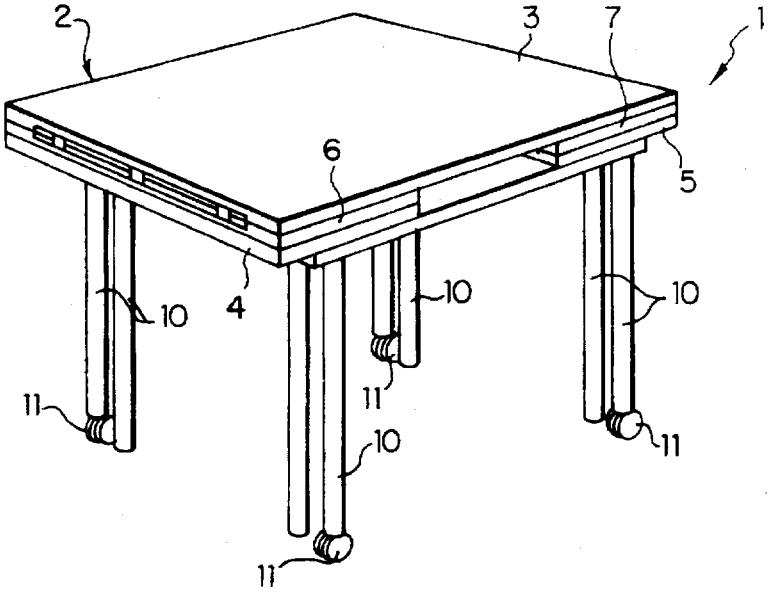
FIG. 1 is a perspective view of a preferred embodiment of the table according to the invention, in its shortened condition.
Figure 3:
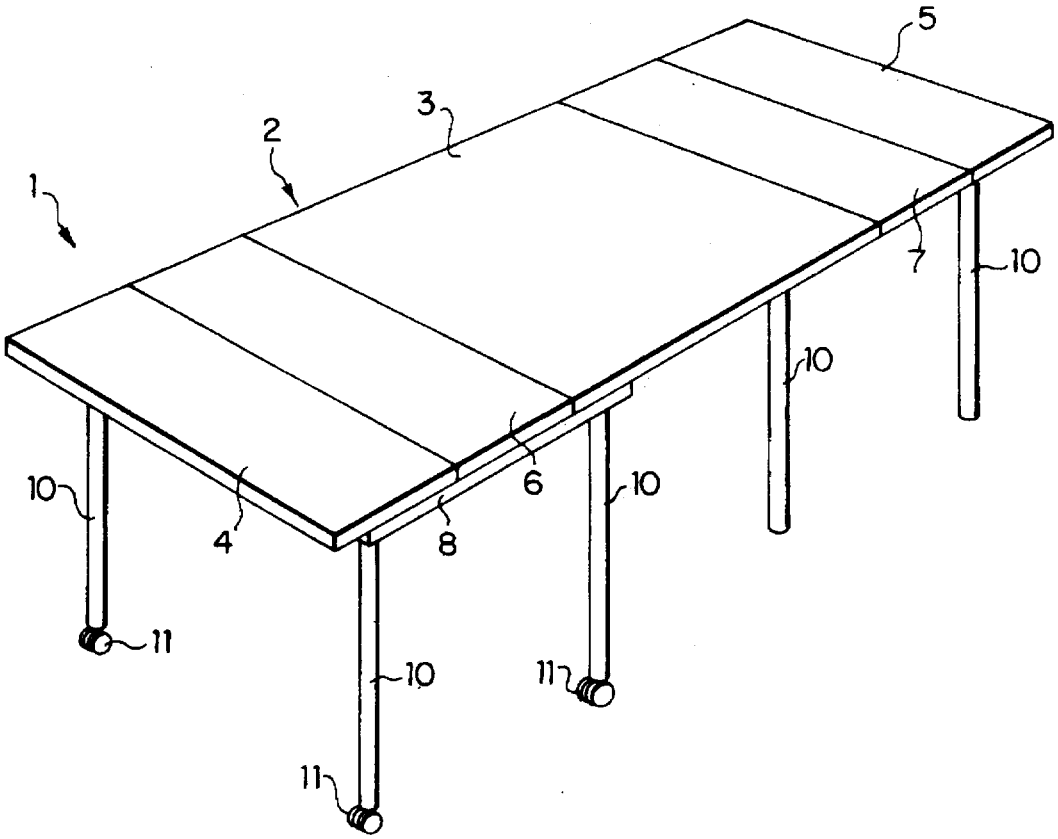
FIG. 3 is a perspective view of the table of FIG. 1 in the extended condition.
Figure 8:
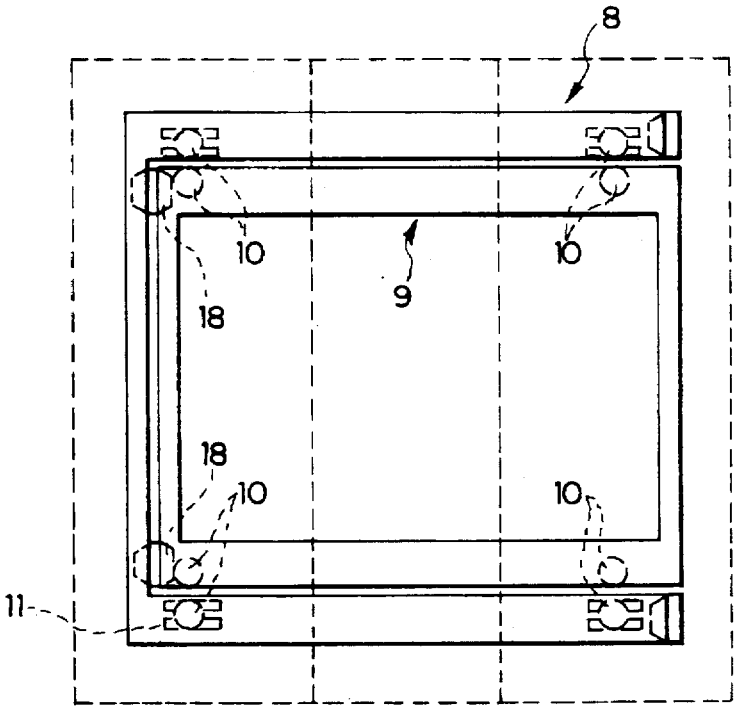
FIG. 8 is a top view, with the board shown only in dotted lines, of the table of FIG. 1.
Figure 6:
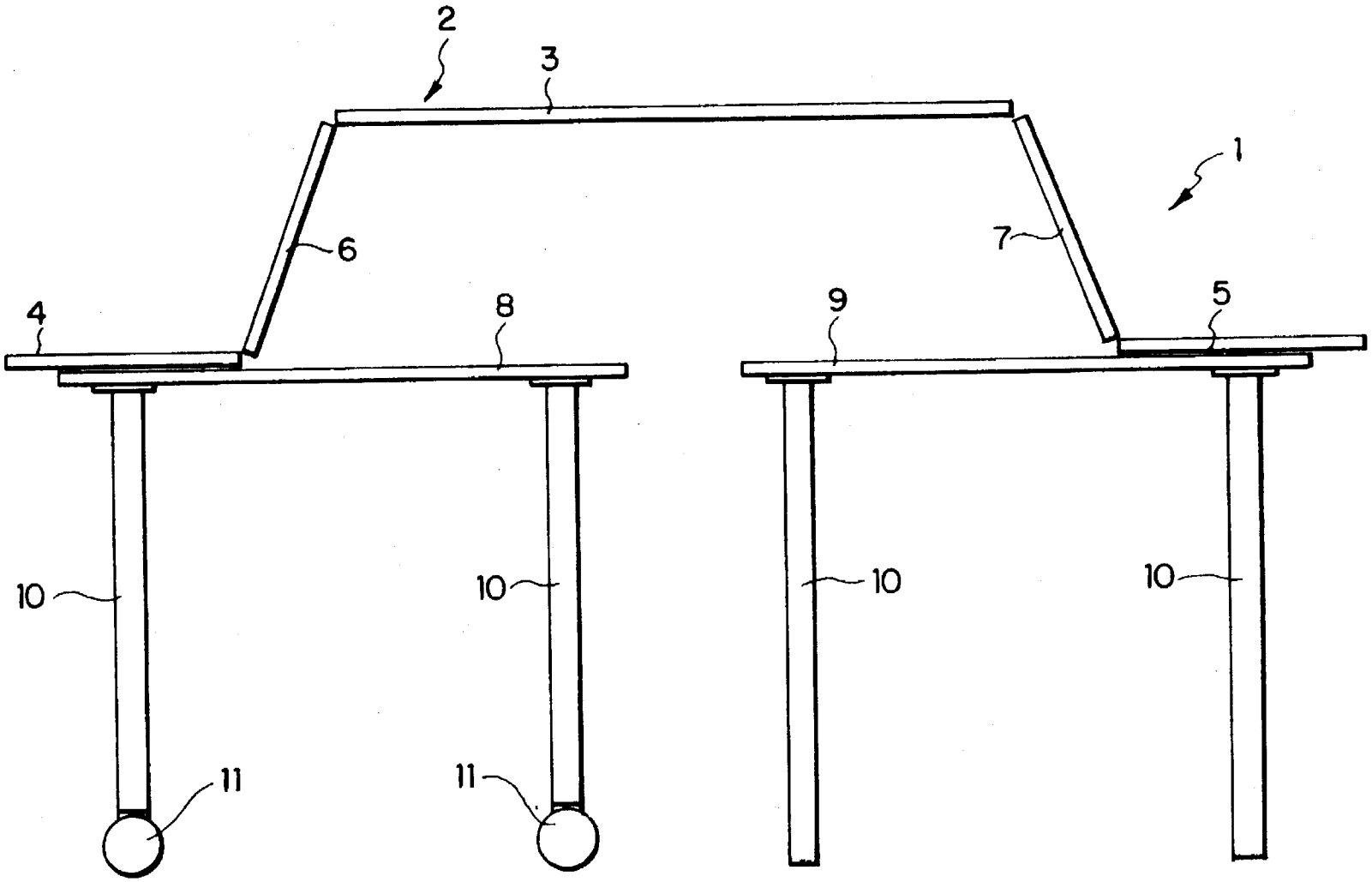
FIG. 6 is a side view of the table in the condition of FIG. 2.

With reference to the drawings, reference numeral 1 generally designates an extensible table comprising a foldable board 2 which includes a central portion 3, which in the illustrated example is of square shape, connected at its two opposite sides to two end board portions 4, 5 by means of two intermediate board portions 6, 7. Each of the two intermediate board portions 6, 7 is pivotally connected on one side to the respective end portion 4 or 5, and on the opposite side to the central portion 3, so that the foldable board 2 of the table is able to assume a first fully extended operative condition, shown in FIG. 3, and a second folded operative condition (FIG. 1) in which the intermediate portions 6, 7 and the end portions 4, 5 are folded below the central board portion 3 which in this condition forms the only board of the table. The two end portions 4, 5 are respectively carried by two frames 8, 9 both lying in a substantially horizontal plane. Frame 9, in the illustrated example, has a general frame-like configuration, whereas frame 8 has a general U-shaped configuration and is for receiving therewithin the frame 9 in the shortened condition of the table (FIG. 8). Both frames 8, 9 are provided with legs 10 which, only in case of the frame 8, are provided at its lower ends with wheels 11 rotatable around axes parallel to the articulation axes of the portions of the table 2.

Figure 2:
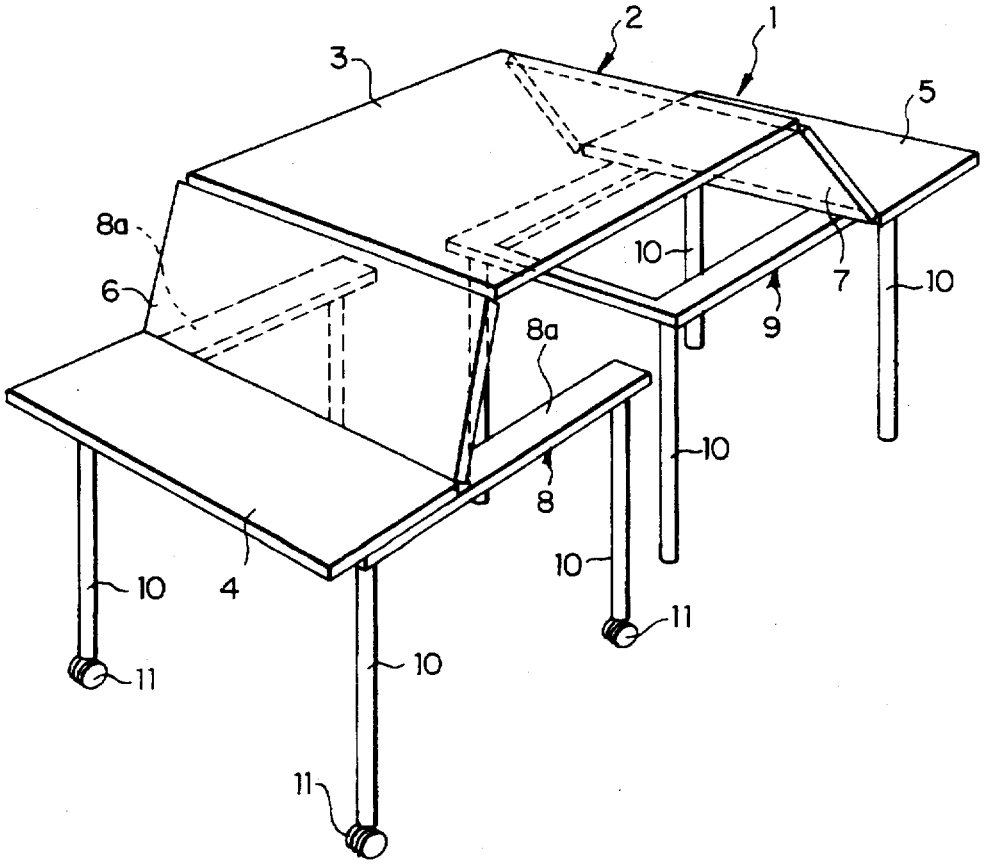
FIG. 2 is a perspective view of the table of FIG. 1 in an intermediate transitional condition between the shortened condition and the extended condition.
Figure 4:
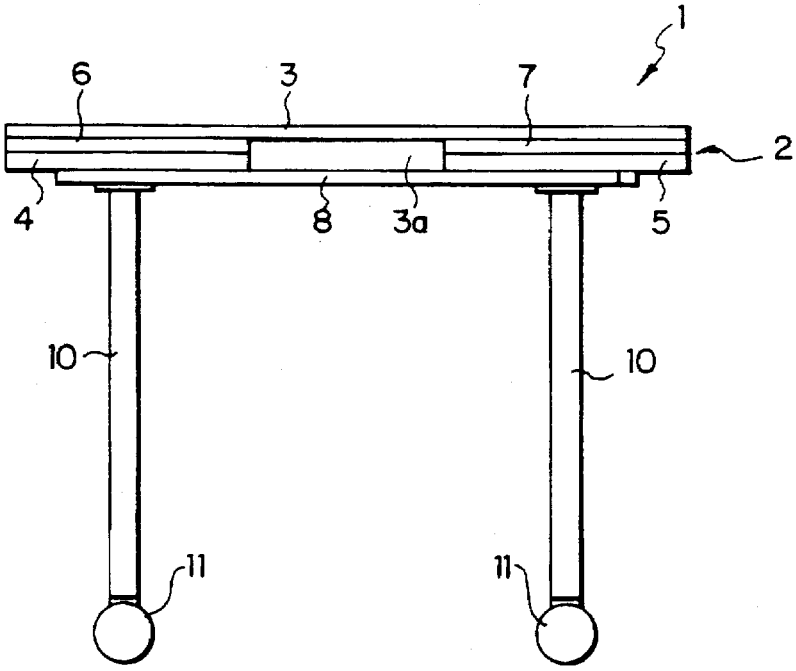
FIG. 4 is a side view of the table in the condition of FIG. 1.
Figure 5:
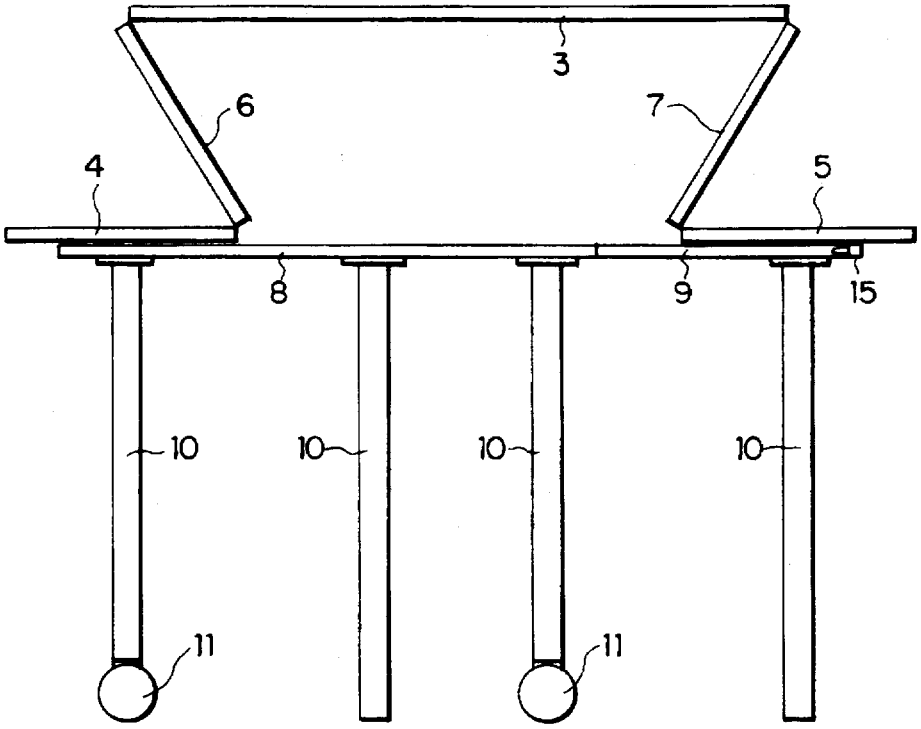
FIG. 5 is a side view of the table in a further transitional intermediate condition.

As shown in the drawings, the intermediate board portions 6, 7 and the end portions 4, 5 each have a rectangular shape with the longer side of the same length as the side of the square of the central portion 3 and the shorter side of a length lower than one half of the side of said square. Therefore, in the shortened condition of the table (FIGS. 1, 4), in which the end portions 4, 5 and the intermediate portions 6, 7 are folded below the central portion 3, there is defined a central gap 3*a* below board portion 3 which enables the user to grasp easily the central portion 3 and raise it upwardly. This raising movement (FIG. 5) causes the two frames 8, 9 to simultaneously move away from each other without requiring any relevant effort to the user, since the frame 8 is mounted on wheels 11. FIGS. 5, 2 show two subsequent transitional positions of the table board, before the latter reaches the fully extended position shown in FIG. 3. As shown, in said fully extended condition, the central portion 3 of board 2 rests on both frames 8, 9, the end portion 4 and the intermediate portion 6 rest on frame 8, whereas end portion 5 and intermediate portion 7 rest on frame 9.

Naturally, while the preferred embodiment of the invention which is shown in the drawings has a central board portion 3 which is extended on both its opposite sides, the table according to the invention may be provided with a board portion which is extensible only on one of its sides, by a structure similar to that described above.

Each of the two frames 8, 9 is comprised of tubular sheet metal elements, with a flattened rectangular cross section. As shown in FIG. 16, legs 10 are also formed by tubular sheet metal elements whose upper ends are welded to anchoring plates 12 which are fixed by screws 13 to internally threaded bushes 14 which are mounted through the tubular sheet metal element forming part of the frame and are anchored to the latter (see also FIG. 14). As shown in FIG. 14, each anchoring plate 12 has in top view a configuration which is symmetrical only with respect to one axis and which makes easier recognizing the proper orientation of the plate when assembling the table.

Figure 7:
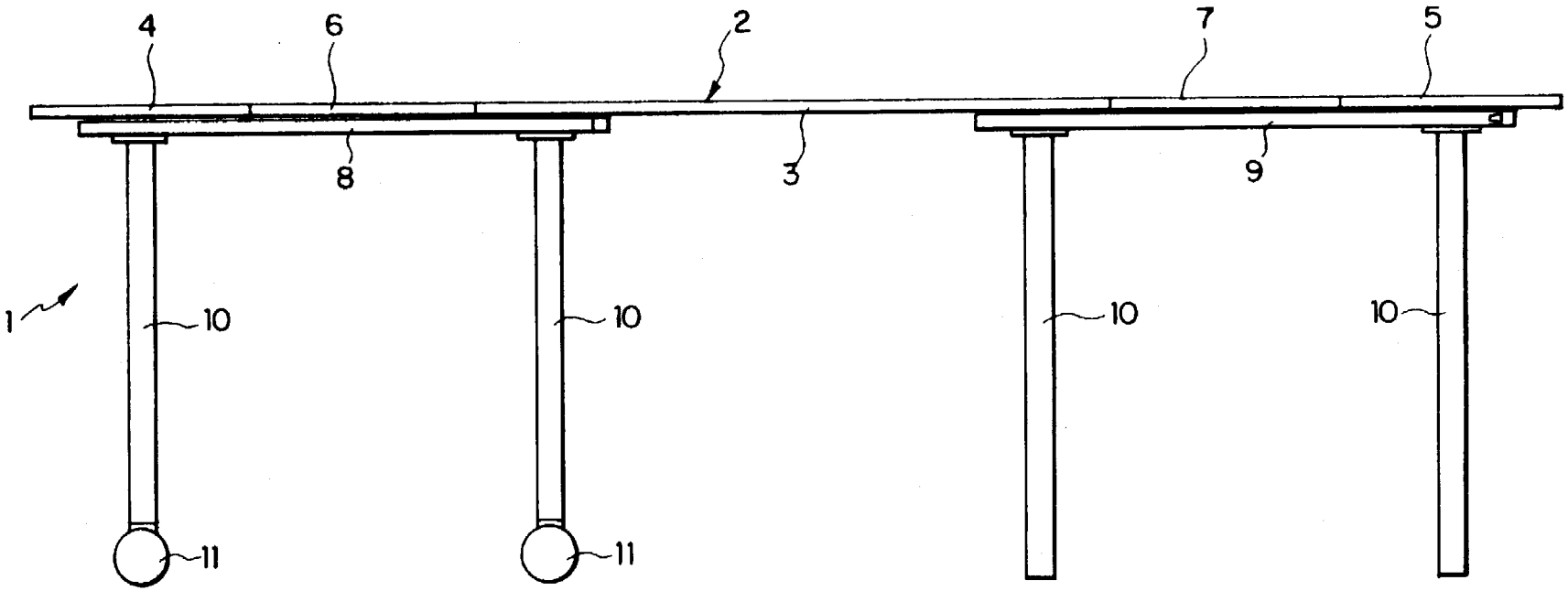
FIG. 7 is a side view of the table in the condition of FIG. 3.
Figure 9:
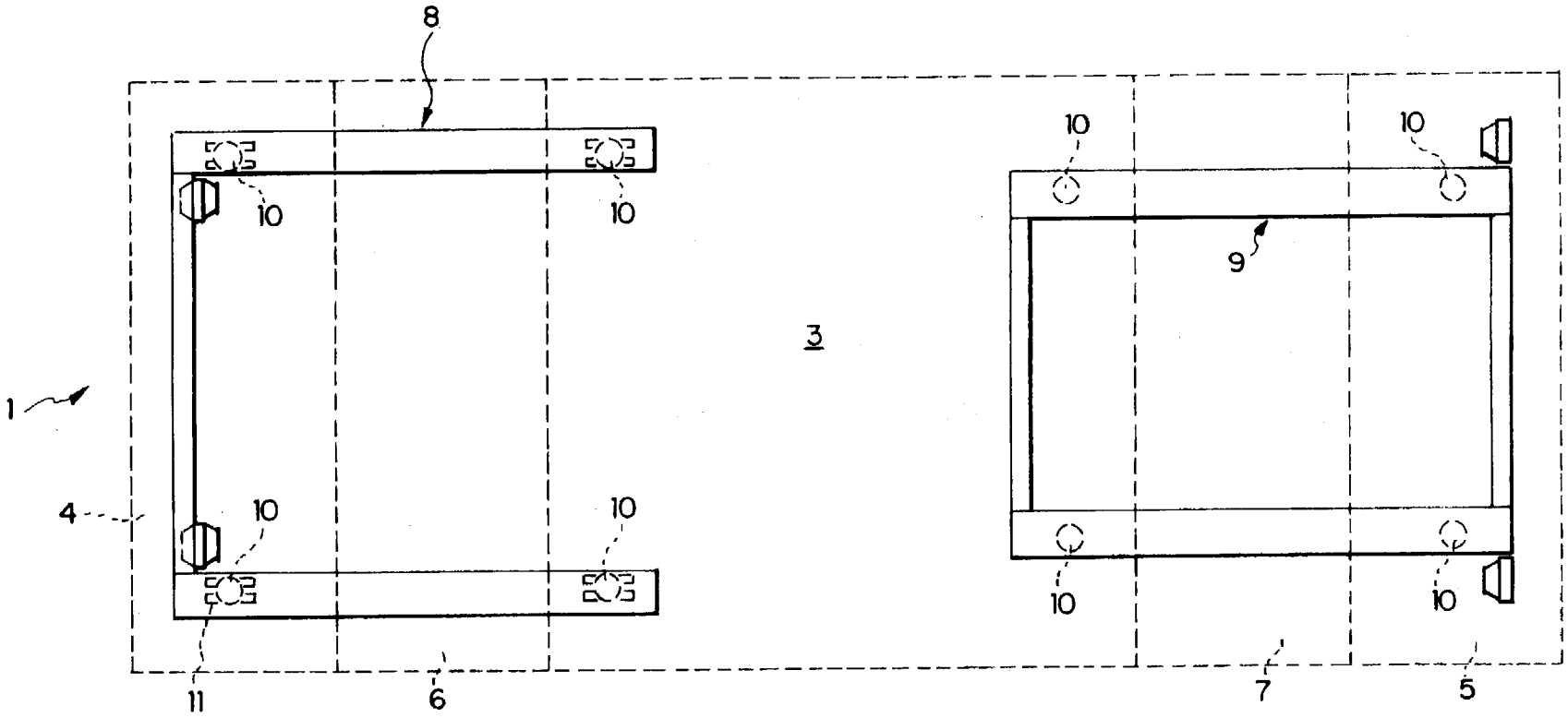
FIG. 9 is a top view, with the board shown only in dotted lines, of the table in the condition of FIG. 3.
Figure 10:
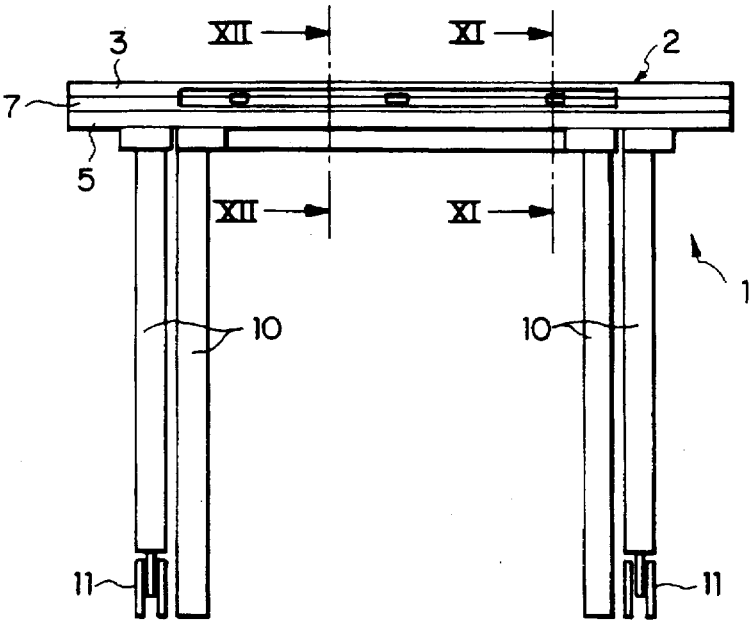
FIG. 10 is a further side view of the table in the condition of FIG. 1, FIG. 11 a partial view in cross section taken along line XI—XI of FIG. 10, at an enlarged scale.

In the shortened position of the table, the opened ends of the tubular elements 8a (FIG. 2) forming the wings of the U-shaped frame 8 receive with close fit the horizontal studs 15 (FIGS. 7, 11) having a tapered configuration and forming part of respective bodies of plastic material 16 which are fixed by screws 17 below the end portion 5 of the table board, which for example can be made of wood. Similarly, in said shortened condition, two further horizontal studs (FIGS. 8, 14, 15) are received within apertures 9*a* formed in frame 9. Also horizontal studs 18 form part of bodies of plastic material which are fixed in this case to the end board portion 4 by screws 19. These bodies further comprise flat appendages 20 (FIG. 15) which are inserted between the lower surface of board portion 4 and frame 8 so that the latter is fixed to board portion 4 but at the same time is slightly spaced apart therefrom.

Figure 13:
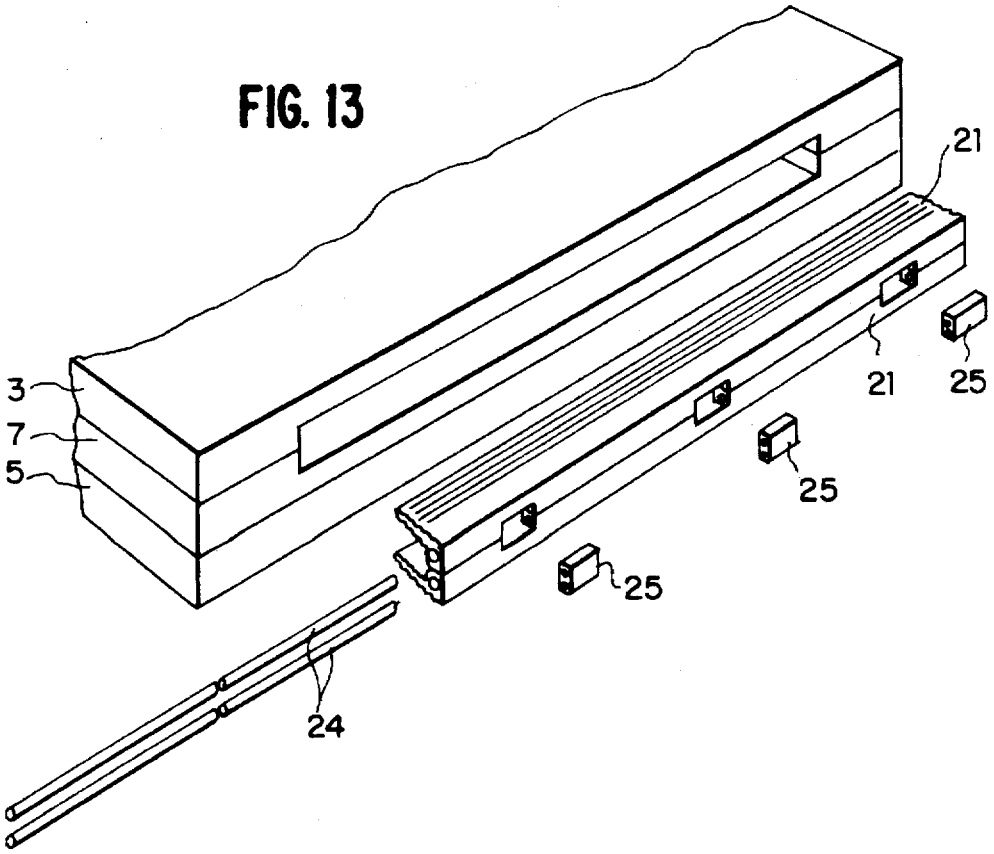
FIG. 13 is an exploded perspective view of the detail shown in FIGS. 11, 12.
Figure 11:
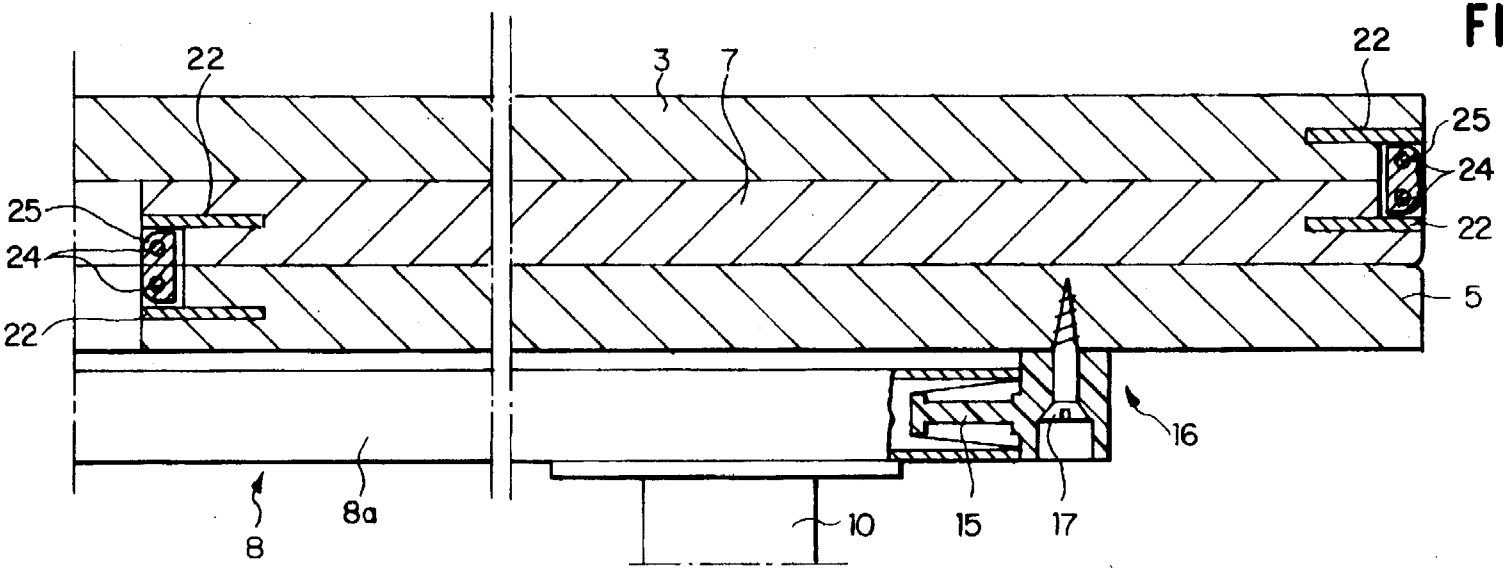
Figure 12:
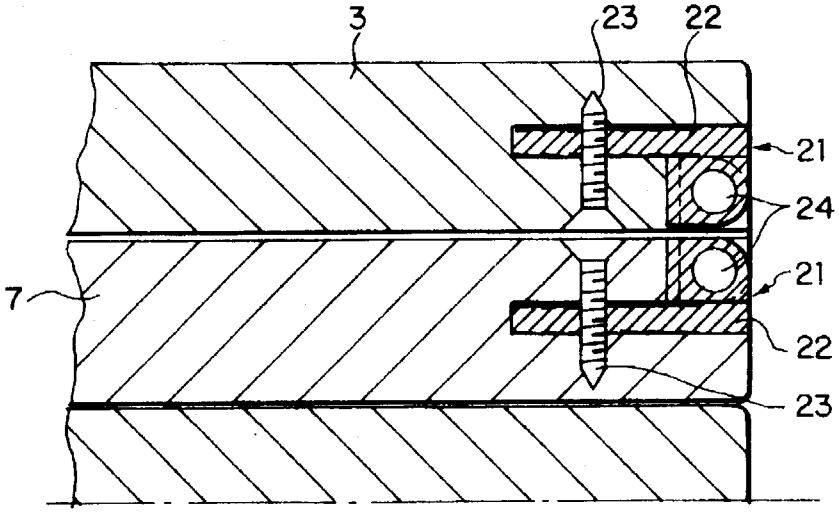
FIG. 12 is a partial cross-sectional view, at an enlarged scale, taken along line XII—XII of FIG. 10.

FIGS. 11–13 show an embodiment of the hinges which connect the various portions of the foldable board 2 of the table. As shown, each hinge comprises two hinge elements formed by two elongated plates 21, for example made of aluminium, including portions 22 (FIG. 12) with a pine-like cross section which are fitted within corresponding seats cut in the wooden board portions and fixed by screws 23. The two hinge elements have through circular holes which receive two hinge elongated pins 24 (FIG. 13) which engage a plurality of linkage members 25, which are also made for example of aluminium, each of which has two through holes for receiving articulation pins 24. Naturally, any other type of hinge device may be used in the table according to the invention.

As clearly apparent from the foregoing description, the table has a structure extremely simple and inexpensive to manufacture, easy to be assembled and of convenient and easy use. As already indicated, the table may be provided with a board 3 which is extensible only on one side. Similarly, the two frames 8, 9 may have also configurations different from those shown, provided that these frames do not interfere with each other in the shortened condition of the table. Finally, both frames may be provided with wheels.

Naturally, while the principle of the invention remains the same, the details of construction and the embodiments may widely vary with respect to what has been described and illustrated purely by way of non limiting example, without departing from the scope of the present invention.

What is claimed is:

1. An Extensible table comprising a foldable board and a pair of base structures, said foldable board having opposite end portions rigidly connected to and providing the sole connection between said pair of respective base structures, said base structures being displaceable between a first operative condition, in which they are spaced apart from each other, with the foldable board fully extended, and a second operative condition, in which they are adjacent to each other, with the foldable board folded, said base structures being provided with means for their mutual fitting in said second operative condition;

wherein said foldable board comprises a central portion, said end portions and two intermediate board portions with each intermediate portion being articulated on one side to a respective end portion of the foldable board and, on an opposite side, to said central portion, so that in said second operative condition the central portion forms a table board, with the two intermediate board portions and the two end portions folded therebelow.

2. Table according to claim 1, wherein the two base structures each comprise an upper frame lying in a horizontal plane and connected to the respective end portion of the foldable board, and a lower part with legs, wherein wheels are mounted on the legs of one of said base structures and said upper frames of the two base structures configured to interfit with each other in said second operative position.

3. Table according to claim 2, wherein only one of the two base structures has legs provided at the lower ends thereof with wheels.

4. Table according to claim 2, wherein one of said frames of the two base structures has a quadrangular frame structure and the other frame has a U-shaped structure co-planar with said quadrangular frame for receiving therewithin said quadrangular frame structure in said second operative condition.

5. Table according to claim 4, wherein the U-shaped frame and the quadrangular frame are formed by tubular elements with a rectangular shaped cross section.

6. Table according to claim 1, wherein said means for mutual fitting comprise horizontal studs fixed to the lower surface of the two end portions of the table board and adapted to be received each within a cooperating aperture provided in the frame carrying the other end portion of the table board when the table is in its second operative condition, said studs being of plastic material and having a tapered configuration.

7. Table according to claim 6, wherein said studs which are for engaging the quadrangular frame form part of bodies of plastic material further including flat appendages which are interposed between the lower surface of the respective end portion of the table and the U-shaped frame.

* * * * *